United States Patent [19]

Christiansen

[11] 3,982,353

[45] Sept. 28, 1976

[54] DOLL HEAD MOUNTING JOINT

[75] Inventor: Godtfred Kirk Christiansen, Billund, Denmark

[73] Assignee: Interlego A.G., Switzerland

[22] Filed: Jan. 31, 1975

[21] Appl. No.: 546,033

[52] U.S. Cl. ..... 46/22
[51] Int. Cl.[2] ..... A63H 33/06
[58] Field of Search ..... 46/164, 22, 25

[56] References Cited

UNITED STATES PATENTS

| | | | |
|---|---|---|---|
| 267,212 | 11/1882 | Johnson | 46/164 |
| 1,370,303 | 3/1921 | Gillespie | 46/22 |
| 1,374,343 | 4/1921 | Wiener | 46/164 |
| 2,838,873 | 6/1958 | Taylor | 46/164 |
| 3,233,358 | 2/1966 | Dehm | 46/25 |
| 3,716,939 | 2/1973 | Pibet | 46/25 |
| 3,731,422 | 5/1973 | McFarland | 46/25 X |

FOREIGN PATENTS OR APPLICATIONS

| | | | |
|---|---|---|---|
| 630,302 | 10/1949 | United Kingdom | 46/25 |

*Primary Examiner*—F. Barry Shay
*Attorney, Agent, or Firm*—Stevens, Davis, Miller & Mosher

[57] ABSTRACT

A doll head is provided with a neck for mounting the head on a body portion comprising a block having a central cavity and four studs arranged symmetrically around the cavity. The neck comprises three axially spaced coaxial portions, of which the one remote from the head has a diameter substantially equal to the diameter of the cavity in the block. The intermediary neck portion has a diameter substantially equal to the diameter of a circle inscribed between the four studs, while the diameter of the neck portion adjacent to the head is too large to enable this portion to be inserted between the four studs. The doll head has other connecting portions thereon for attaching toy elements.

1 Claim, 3 Drawing Figures

DOLL HEAD MOUNTING JOINT

This invention relates to figure toys, such as dolls or animal toys, comprising a plurality of pieces adapted to be assembled and disassembled in various combinations and to be interchangeably connected to toy building blocks in a toy building set.

More particularly, the invention relates to means for readily connecting a doll head with a block forming part of a doll's body.

The main object of the invention is to provide a doll head having a neck portion constituting a mounting joint which enables the head to be interchangeably connected with a body portion of the doll.

Other objects and features of the invention will appear from the following description with reference to the drawings.

Figure 1:
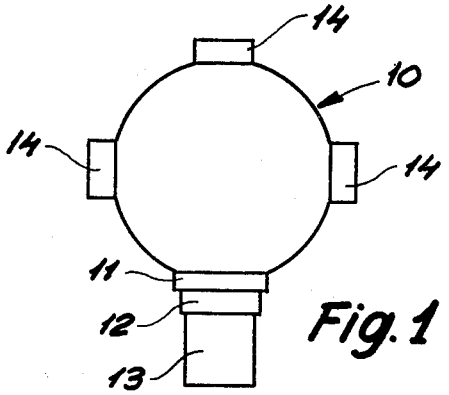
FIG. 1 is a front elevation of a doll head.

Referring to the embodiment of the invention shown in the drawings, 10 is a doll head in the form of a sphere having projections or studs 14 for interconnecting the head with other toy elements of a toy building set.

Figure 2:
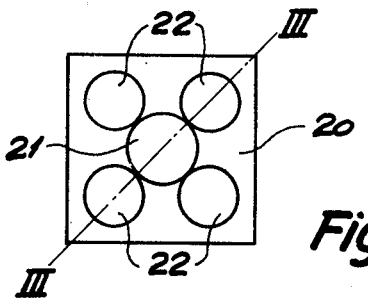
FIG. 2 is a top view of a body portion adapted to be connected with the head.

The head 10 is provided with a body connecting neck portion for detachably mounting the head in a body portion comprising a block 20 as shown in FIG. 2.

The neck portion comprises three axially spaced coaxial portions 11, 12 and 13.

The body portion comprises a square block 20 having a central cavity 21 and four studs 22 projecting symmetrically about the cavity 21 above the mouth thereof.

The diameter of the cavity 21 is substantially equal to the diameter of the neck portion 13 most remote from the head, and the diameter of the intermediate portion 12 is slightly greater than the diameter of a circle inscribed tangent to the studs 22. Finally, the portion 11 nearest to the head is too large to be inscribed by the studs 22.

Figure 3:
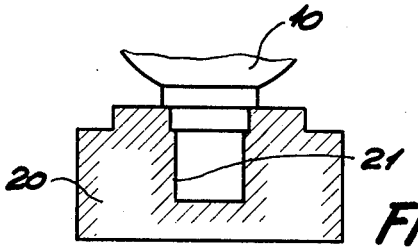
FIG. 3 is a section taken on the line III—III of FIG. 2.

With this arrangement, the neck portion 13 may be introduced into the central cavity 21 and be pushed axially therein until the intermediate portion 12 is snapped in between the studs 22 and is frictionally held therebetween while the lower face of the neck portion 11 touches the top of all four studs 22 as can be seen from FIG. 3 this neck portion 11 is visible above the studs 22.

The head 10 with the neck portion 11,12,13 and the block 20 with the studs 22 are preferably made by injection moulding of a thermoplastic material.

What I claim is:

1. A mounting joint for quick detachably connecting a doll head to a supporting block comprising a doll head having at least three means thereon for connecting elements thereto, one of said means comprising a cylindrical body connecting portion projecting from said head, said portion including three axially spaced coaxial sections each being of a different diameter, the one nearest the head being of greatest diameter, the most remote from the head being of the least diameter;

a body forming block adapted to receive said portion, said block having a central cavity and four studs projecting symmetrically about said cavity above the plane of its mouth, the diameter of said section most remote from said head being equal to that of said cavity, the diameter of said intermediate section being slightly greater than a circle tangent to the vertical surfaces of the studs at a point on said vertical surface of said stud nearest the cavity, the intermediate portion being thus frictionally engageable with the vertical surfaces at the said points of tangency, and the portion nearest the head constituting the neck of said doll head, being too large to be engaged within said vertical surfaces and abutting the tops of said four studs whereby said neck portion is visible above said studs.

* * * * *